US006431684B1

(12) United States Patent
Olsen

(10) Patent No.: US 6,431,684 B1
(45) Date of Patent: Aug. 13, 2002

(54) SPRING PAD FOR ELECTRICAL INTERCONNECTION OF INKJET PRINTING SYSTEM

(75) Inventor: Kurt F. Olsen, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/920,028

(22) Filed: Aug. 1, 2001

(51) Int. Cl.[7] ..... B41J 2/14

(52) U.S. Cl. ..... 347/50

(58) Field of Search ..... 347/49, 50, 87, 347/86

(56) References Cited

U.S. PATENT DOCUMENTS

| | | | |
|---|---|---|---|
| 4,706,097 A | 11/1987 | Harmon | 345/561 |
| 4,907,018 A | 3/1990 | Pinkerpell et al. | 346/139 R |
| 5,461,482 A | 10/1995 | Wilson et al. | 347/50 |
| 5,642,143 A | 6/1997 | Rhoads | 347/49 |

*Primary Examiner*—Anh T. N. Vo

(57) ABSTRACT

A spring pad for ensuring electrical interconnection between electrical contacts of a printer carriage and corresponding electrical contacts of a print cartridge installed in the printer carriage includes a base having a first side and a second side opposite the first side, and a plurality of resilient bumps protruding from the first side of the base. Each of the resilient bumps have a substantially semi-ellipsoidal shape and include a hollow interior communicating with the second side of the base.

34 Claims, 8 Drawing Sheets

SPRING PAD FOR ELECTRICAL INTERCONNECTION OF INKJET PRINTING SYSTEM

THE FIELD OF THE INVENTION

The present invention relates generally to inkjet printers, and more particularly to an inkjet printing system including a spring pad which ensures electrical interconnection between electrical contacts of a printer carriage and corresponding electrical contacts of a print cartridge installed in the printer carriage.

BACKGROUND OF THE INVENTION

A conventional inkjet printing system includes a printhead assembly, an ink supply which supplies liquid ink to the printhead assembly, and an electronic controller which controls the printhead assembly. The printhead assembly, commonly referred to as a print cartridge or pen, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead assembly and the print medium are moved relative to each other.

To position the printhead assembly relative to the print medium, the conventional inkjet print system includes a carriage assembly. As such, the printhead assembly is positioned in and supported by the carriage assembly. Typically, electrical signals which control and/or monitor operation of the printhead assembly are communicated between the electronic controller and the printhead assembly via the carriage assembly.

To communicate electrical signals between the electronic controller and the printhead assembly via the carriage assembly, the printhead assembly and the carriage assembly each include a plurality of electrical contacts. As such, the electrical contacts contact each other and establish an electrical interconnection between the printhead assembly and the carriage assembly when the printhead assembly is positioned in the carriage assembly. Understandably, the electrical contacts of the carriage assembly are electrically coupled to the electronic controller such that electrical signals are communicated between the electronic controller and the printhead assembly via the carriage assembly.

In one arrangement, the electrical contacts of the carriage assembly are part of a flexible electrical circuit which includes conductive traces formed in a flexible base material. As such, the flexible electrical circuit can flex to accommodate positional variations of the electrical contacts of the printhead assembly and/or the electrical contacts of the carriage assembly. Such variations may be caused, for example, by manufacturing tolerances of the printhead assembly and/or carriage assembly. Thus, to ensure electrical contact between the electrical contacts of the printhead assembly and the electrical contacts of the carriage assembly, compensators including elastomeric or spring pads have been associated with the flexible electrical circuit to bias the flexible electrical circuit and compensate for positional variations.

With existing elastomeric or spring pads, however, a force created between the electrical contacts of the printhead assembly and the electrical contacts of the carriage assembly typically increases as the elastomeric or spring pad is compressed. Thus, existing elastomeric or spring pads may develop excessive forces at maximum displacement. Such excessive forces may result in improper fit of the printhead assembly and the carriage assembly as well as damage to the carriage assembly and/or printhead assembly if the forces exceed the allowable design loads. To accommodate the high clamping forces required with existing spring pads, the carriage assembly must be made stiffer and the clamping system must be made stronger thus increasing the cost and size of the system.

Accordingly, a need exist for improving electrical contact between the electrical contacts of a print cartridge and the corresponding electrical contacts of a printer carriage in which the print cartridge is to be installed. In particular, a need exists for a spring pad which minimizes a maximum force developed between the electrical contacts of the print cartridge and the electrical contacts of the printer carriage when the print cartridge is installed in the printer carriage.

SUMMARY OF THE INVENTION

One aspect of the present invention provides a spring pad. The spring pad includes a base having a first side and a second side opposite the first side, and a plurality of resilient bumps protruding from the first side of the base. Each of the resilient bumps have a substantially semi-ellipsoidal shape and include a hollow interior communicating with the second side of the base.

Another aspect of the present invention provides a carriage assembly adapted to hold a printhead assembly of an inkjet printing system. The carriage assembly includes a carriage adapted to support the printhead assembly, a plurality of electrical contacts provided along a sidewall of the carriage, and a spring pad interposed between the sidewall of the carriage and the plurality of electrical contacts. As such, the spring pad includes a plurality of resilient bumps each adapted to bias a respective one of the electrical contacts away from the sidewall of the carriage. Each of the resilient bumps have a substantially semi-elliptical cross-section.

Another aspect of the present invention provides an inkjet printing system. The inkjet printing system includes a print cartridge including an inkjet printhead assembly and a first plurality of electrical contacts electrically coupled to the inkjet printhead assembly, and a printer carriage including a second plurality of electrical contacts. As such, the printer carriage is adapted to hold the print cartridge and the first plurality of electrical contacts are adapted to contact the second plurality of electrical contacts. In addition, the printer carriage includes a plurality of resilient bumps each associated with one of the second plurality of electrical contacts such that each of the resilient bumps are adapted to provide a substantially constant force between one of the first plurality of electrical contacts and one of the second plurality of electrical contacts when compressed.

Another aspect of the present invention provides a method of electrically connecting a print cartridge including an inkjet printhead assembly and a printer carriage adapted to support the print cartridge. The method includes electrically contacting at least one electrical contact of the printer carriage with at least one electrical contact of the print cartridge, and biasing the at least one electrical contact of the printer carriage against the at least one electrical contact of the print cartridge with a resilient bump associated with the at least one electrical contact of the printer carriage. Biasing the at least one electrical contact of the printer carriage against the at least one electrical contact of the print cartridge includes compressing the resilient bump and compressing the resilient bump includes buckling a sidewall of the resilient bump.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printing system and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
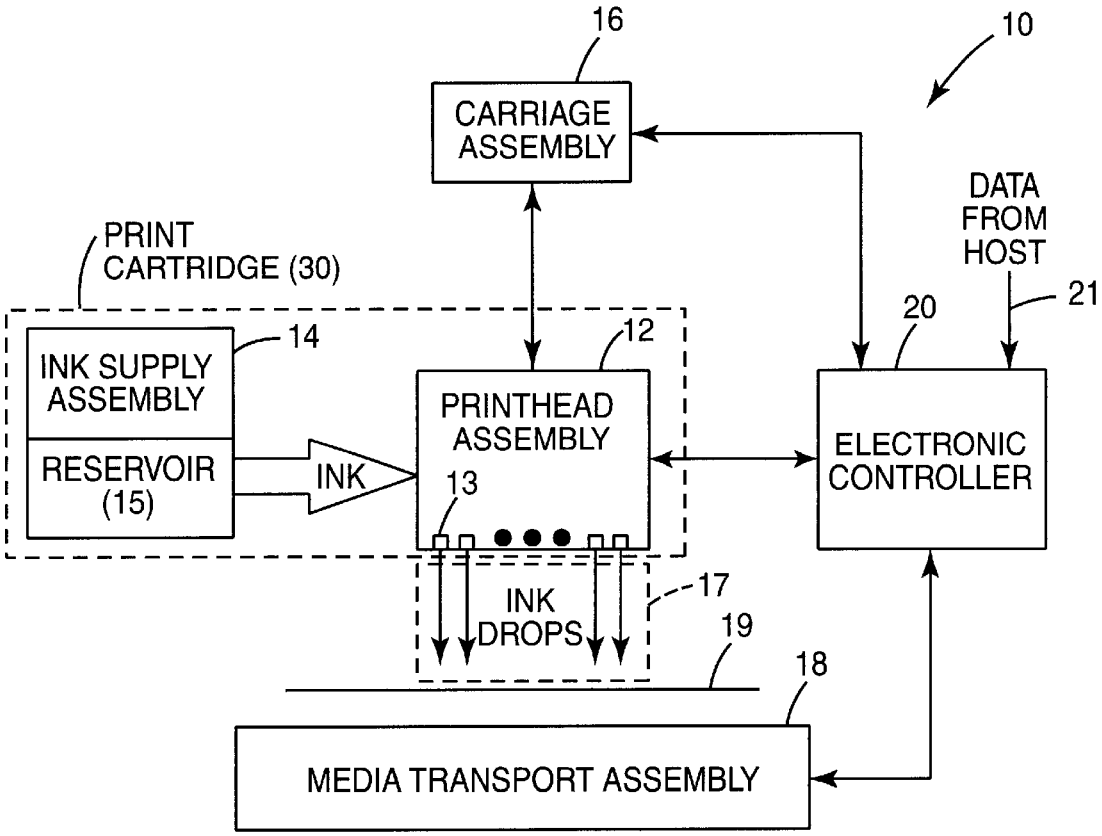
FIG. 1 is a block diagram illustrating one embodiment of an inkjet printing system according to the present invention.

FIG. 1 illustrates one embodiment of a portion of an inkjet printing system 10 according to the present invention. Inkjet printing system 10 includes an inkjet printhead assembly 12, an ink supply assembly 14, a carriage assembly 16, a media transport assembly 18, and an electronic controller 20. Inkjet printhead assembly 12 includes a printhead which ejects drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together in an inkjet print cartridge or pen, as identified by dashed line 30. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled.

Carriage assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, carriage assembly 16 moves inkjet printhead assembly 12 relative to media transport assembly 18 to scan print medium 19. In another embodiment, inkjet printhead assembly 12 is a non-scanning type printhead assembly. As such, carriage assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, carriage assembly 16, and media transport assembly 18. Thus, when inkjet printhead assembly 12 is mounted in carriage assembly 16, electronic controller 20 and inkjet printhead assembly 12 communicate via carriage assembly 16. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
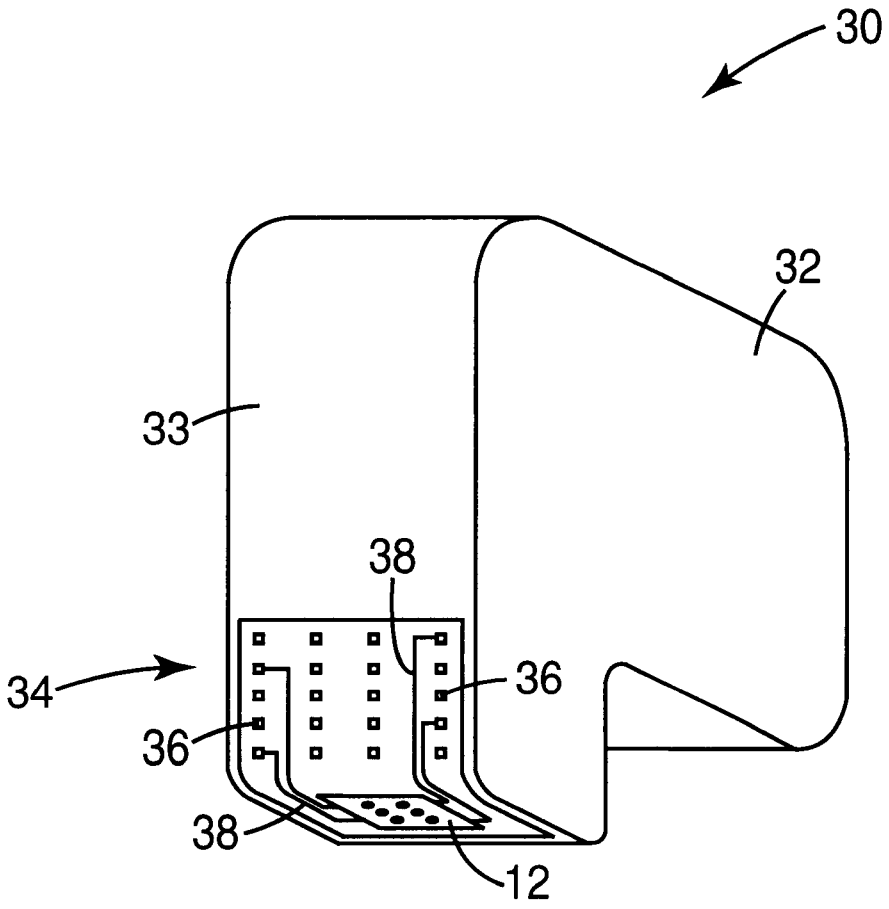
FIG. 2 is a bottom perspective view of one embodiment of an inkjet print cartridge according to the present invention.

FIG. 2 illustrates one embodiment of print cartridge 30. Print cartridge 30 includes a housing 32 which supports inkjet printhead assembly 12 and contains reservoir 15 of ink supply 14. As such, reservoir 15 communicates with inkjet printhead assembly 12 to supply ink to inkjet printhead assembly 12, as is well known in the art. In addition, housing 32 supports an electrical circuit 34 which facilitates communication of electrical signals between electronic controller 20 and inkjet printhead assembly 12 for controlling and/or monitoring operation of inkjet printhead assembly 12.

Electrical circuit 34 includes a plurality of electrical contacts 36 and a plurality of conductive paths 38 which extend between and provide electrical connection between electrical contacts 36 and inkjet printhead assembly 12. As such, electrical contacts 36 provide points for electrical connection with print cartridge 30 and, more specifically, inkjet printhead assembly 12. In one embodiment, electrical contacts 36 are provided along a side 33 of housing 32 of print cartridge 30.

Figure 3:
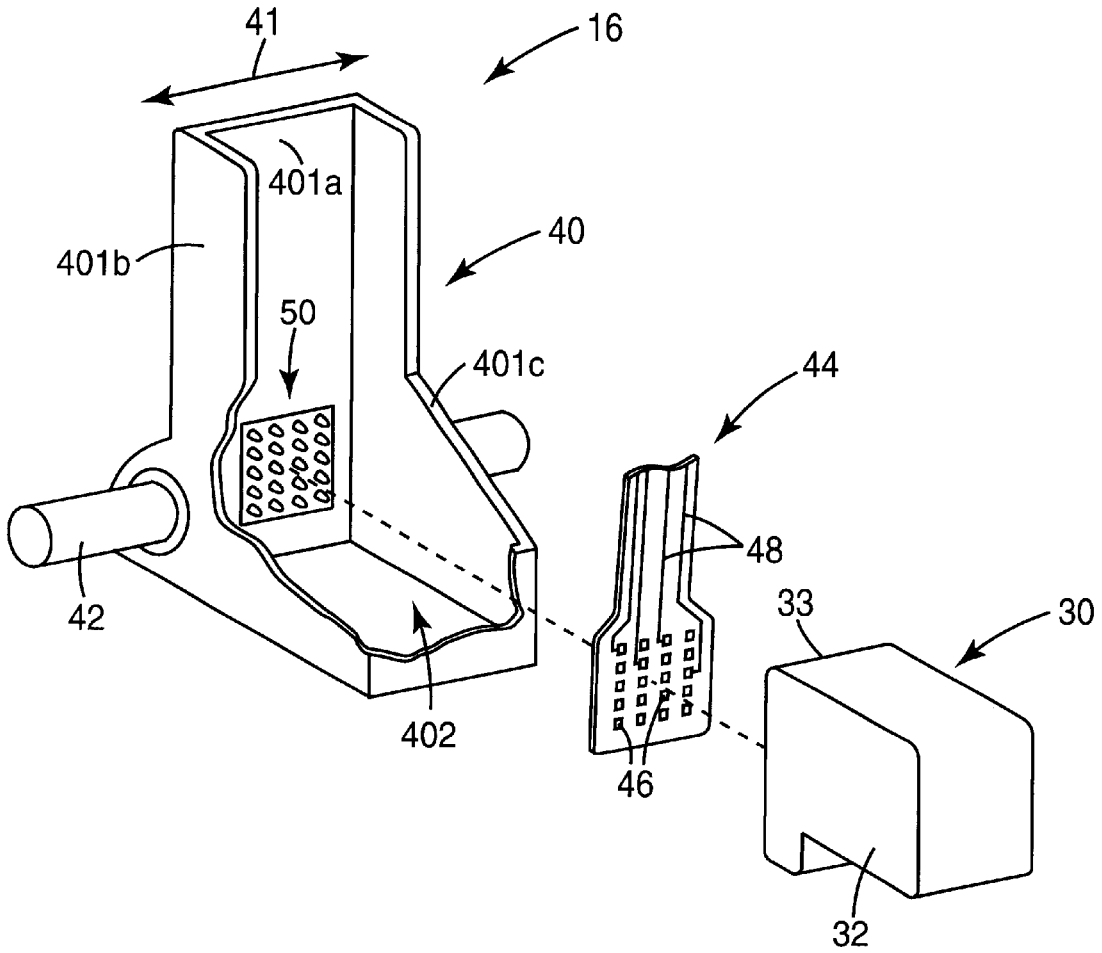
FIG. 3 is an exploded perspective view including the inkjet print cartridge of FIG. 2 and a portion of an inkjet printer carriage according to the present invention.

FIG. 3 illustrates one embodiment of a portion of carriage assembly 16. Carriage assembly 16 includes a printer carriage 40, a carriage rod 42, an electrical circuit 44, and a spring pad 50. Printer carriage 40 carries print cartridge 30, including inkjet printhead assembly 12, and is slidably mounted on carriage rod 42 for lateral movement, as indicated by bi-directional arrow 41. As such, carriage rod 42 provides a guide for printer carriage 40. Thus, printer carriage 40 moves print cartridge 30, including inkjet printhead assembly 12, back and forth across print medium 19.

In one embodiment, printer carriage 40 includes, for example, sidewalls 401*a*, 401*b*, and 401*c* which define a carriage stall 402 of printer carriage 40. As such, carriage stall 402 is sized and configured to receive and support print cartridge 30. Print cartridge 30 is installed and/or positioned in carriage stall 402 such that side 33 of housing 32 is adjacent sidewall 401*a* of printer carriage 40. While carriage assembly 16 and, more specifically, printer carriage 40 is illustrated as including one carriage stall 402, it is understood that carriage assembly 16 may include any number of carriage stalls 402. Multiple carriage stalls may accommodate, for example, multiple print cartridges each including differing colored inks.

Electrical circuit 44 facilitates communication of electrical signals between electronic controller 20 and print cartridge 30. More specifically, electrical circuit 44 facilitates communication of electrical signals between electronic controller 20 and inkjet printhead assembly 12 for controlling and/or monitoring operation of inkjet printhead assembly 12. As such, electrical circuit 44 includes a plurality of electrical contacts 46 and a plurality of conductive paths 48 which terminate at one end at electrical contacts 46. Conductive paths 48 communicate at an opposite end with electronic controller 20 such that electrical signals are communicated between electronic controller 20 and electrical contacts 46 of printer carriage 40 via conductive paths 48.

Preferably, electrical circuit 44 is a flexible electrical circuit. As such, conductive paths 48 are formed in one or more layers of a flexible base material. The base material may include, for example, a polyimide or other flexible polymer material (e.g., polyester, poly-methyl-methacrylate) and conductive paths 48 may be formed of copper, gold, or other conductive material.

In one embodiment, electrical circuit 44 is provided along sidewall 401*a* of printer carriage 40 such that electrical contacts 36 of print cartridge 30 contact electrical contacts 46 of printer carriage 40 when print cartridge 30 is installed in carriage stall 402 of printer carriage 40. To ensure electrical contact between electrical contacts 36 of print cartridge 30 and electrical contacts 46 of printer carriage 40, spring pad 50 is interposed between sidewall 401*a* of carriage stall 402 and electrical circuit 44 of printer carriage 40. More specifically, spring pad 50 is interposed between sidewall 401*a* of carriage stall 402 and electrical contacts 46 of electrical circuit 44. As such, spring pad 50 biases electrical contacts 46 of electrical circuit 44 away from sidewall 401*a* of carriage stall 402 and toward electrical contacts 36 of print cartridge 30.

Figure 4:
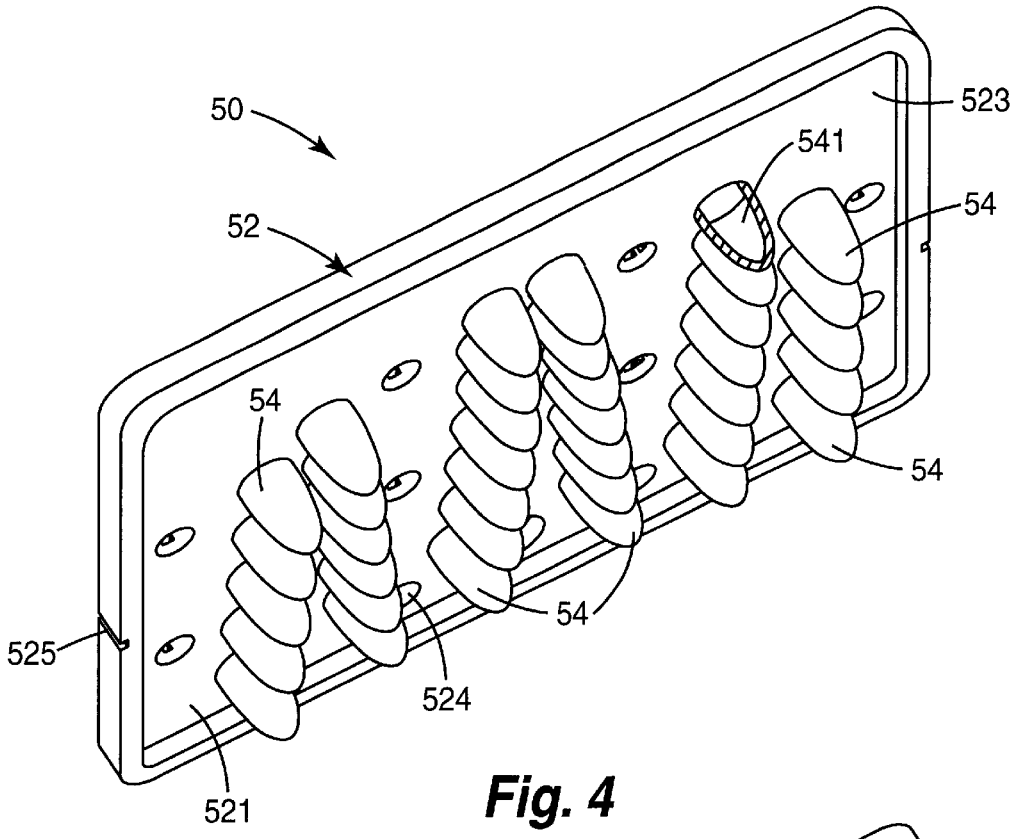
FIG. 4 is a front perspective view of one embodiment of a spring pad according to the present invention.
Figure 5:
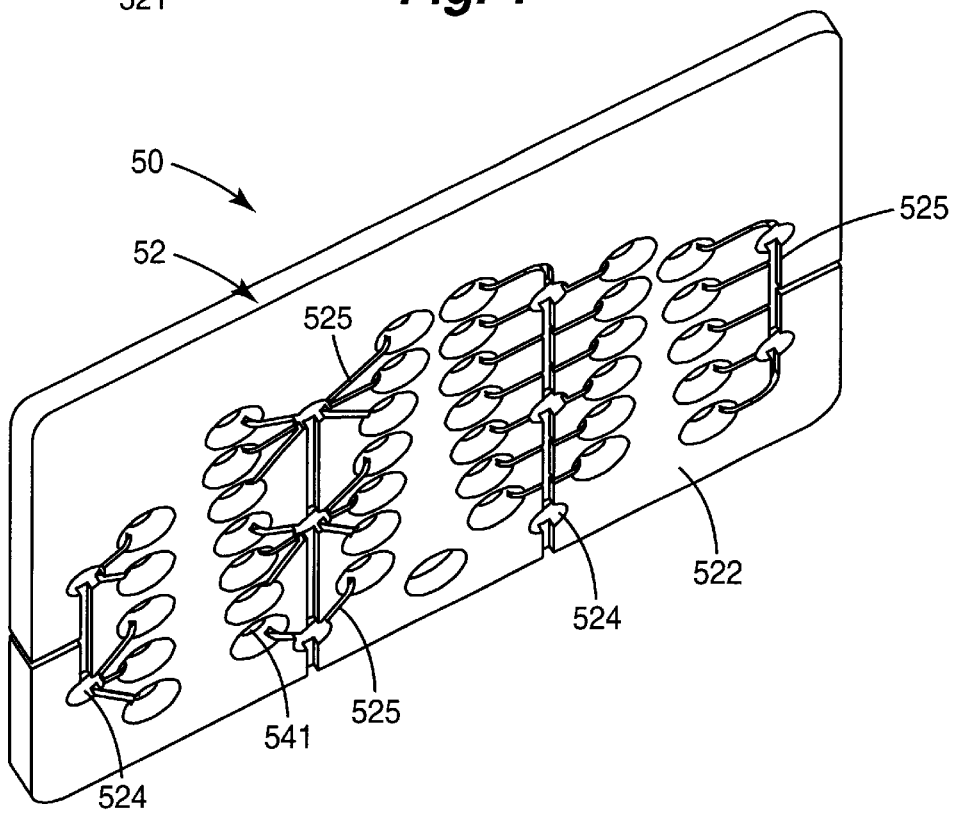
FIG. 5 is a back perspective view of the spring pad of FIG. 4.

In one embodiment, as illustrated in FIGS. 4 and 5, spring pad 50 includes a base 52 and a plurality of resilient bumps 54. Base 52 has a first side 521 and a second side 522 opposite first side 521. Preferably, base 52 includes a substantially planar portion 523 such that first side 521 and second side 522 are oriented substantially parallel to each other.

Figure 6A:
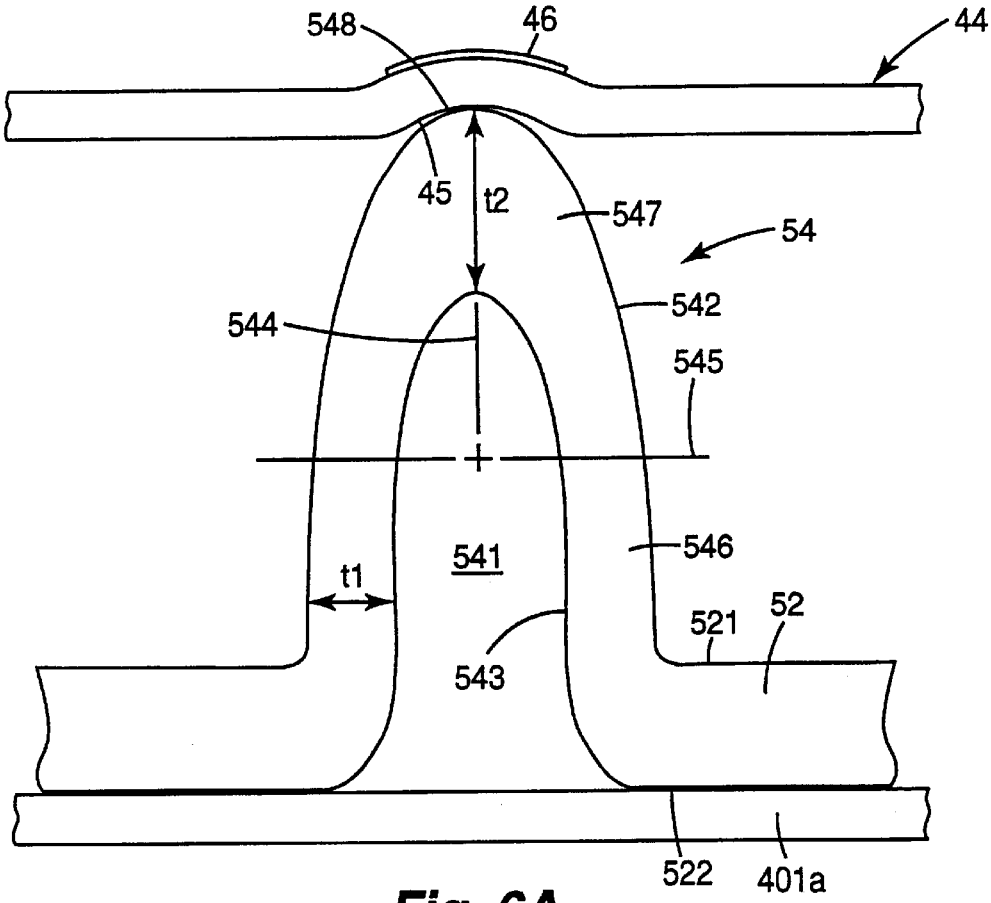
FIG. 6A is a schematic cross-sectional view of one embodiment of a resilient bump of the spring pad of FIG. 4 in an uncompressed state.

Resilient bumps 54 protrude from first side 521 of base 52. More specifically, resilient bumps 54 protrude from planar portion 523 of base 52. In one embodiment, resilient bumps 54 each have a substantially semi-ellipsoidal shape and include a hollow interior 541. As such, hollow interior 541 is open to and communicates with second side 522 of base 52. Spring pad 50 is interposed between sidewall 401*a* and electrical circuit 44 of printer carriage 40 such that second side 522 of base 52 is adjacent sidewall 401*a* and resilient bumps 54 contact electrical circuit 44 and bias electrical contacts 46 away from sidewall 401*a* (FIG. 6A).

Preferably, resilient bumps 54 are formed integrally with base 52. In addition, base 52 and resilient bumps 54 are formed of the same material. It is, however, within the scope of the present invention for resilient bumps 54 to be formed separately from and/or of a different material than base 52. A material suitable for resilient bumps 54 includes a polymer such as silicon rubber. An example of such silicon rubber includes Dow Corning's STI P/N LSR 94-595-HC.

Electrical contacts 46 of printer carriage 40 are arranged in an array coinciding with a layout of electrical contacts 36 of print cartridge 30. As such, resilient bumps 54 are arranged in an array coinciding with a layout of electrical contacts 46 of printer carriage 40. Thus, each resilient bump 54 is associated with one electrical contact 46. In one embodiment, electrical contacts 36 of print cartridge 30 include at least one column of electrical contacts 36. As such, resilient bumps 54 of spring pad 50 include at least one column of resilient bumps 54 corresponding to the at least one column of electrical contacts 36.

In one embodiment, base 52 of spring pad 50 has one or more air vent openings 524 extending therethrough. As such, air vent openings 524 communicate with first side 521 and second side 522 of base 52. In addition, a plurality of air vent channels 525 are formed in second side 522 of base 52. As such, at least one air vent channel 525 communicates with hollow interior 541 of each resilient bump 54 and communicates with at least one air vent opening 524 through base 52 and/or extends from second side 522 to first side 521. Thus, air trapped within hollow interior 541 of resilient bumps 54 can escape from second side 522 of base 52 when resilient bumps 54 are compressed, as described below.

As illustrated in FIG. 6A, resilient bumps 54 each have a substantially semi-elliptical cross-section. As such, resilient bumps 54 each include an outer surface 542 having a substantially semi-elliptical profile and an inner surface 543 having a substantially semi-elliptical profile. Thus, inner surface 543 defines hollow interior 541. In addition, resilient bumps 54 each include a major axis 544 and a minor axis 545. As such, major axis 544 is oriented substantially perpendicular to planar portion 523 of base 52 and minor axis 545 is oriented substantially perpendicular to major axis 544.

Resilient bumps 54 each include a sidewall 546 and a top 547. As such, sidewall 546 is joined to base 52 and top 547 is joined to sidewall 546. Sidewall 546 and top 547 are designed to establish a controlled buckling of resilient bumps 54 when compressed from an uncompressed state to a compressed state, as described below. In one embodiment, sidewall 546 has a thickness t1 and top 547 has a thickness t2. Preferably, thickness t1 of sidewall 546 is less than thickness t2 of top 547. In addition, thickness t2 of sidewall 546 is selected to control a maximum force developed by resilient bumps 54 when compressed yet produce a minimum force necessary to ensure electrical contact between electrical contacts 36 of print cartridge 30 and electrical contacts 46 of printer carriage 40.

Figure 6B:
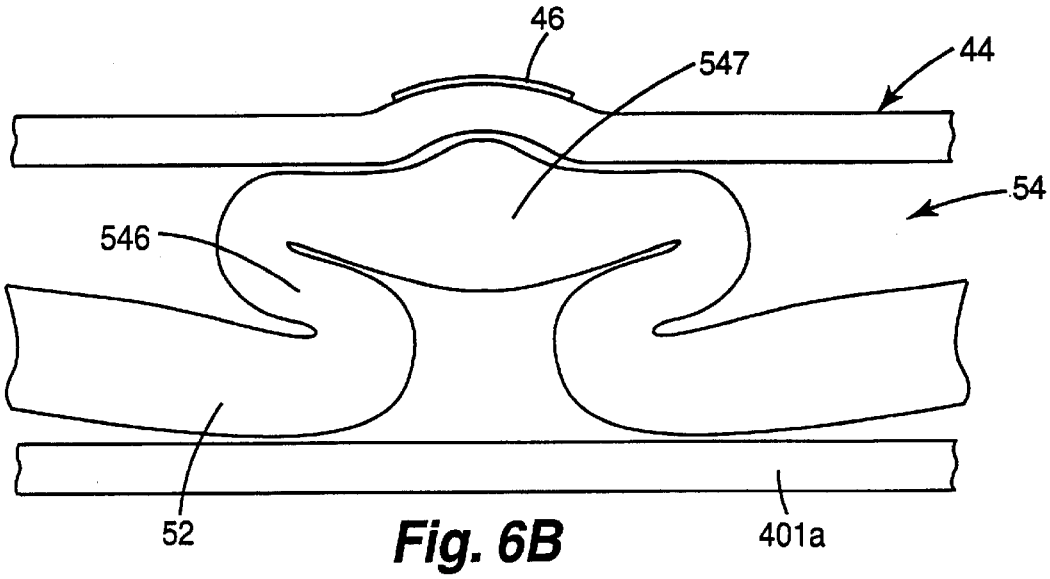
FIG. 6B is a schematic cross-sectional view of the resilient bump of FIG. 6A in a compressed state.

Resilient bumps 54 are each independently compressible between an uncompressed state, as illustrated in FIG. 6A, and a compressed state, as illustrated in FIG. 6B. As resilient bumps 54 are compressed between the uncompressed state and the compressed state, sidewall 546 of a respective resilient bump 54 buckles. As such, a portion of sidewall 546 overlays a portion of base 52 and a portion of top 547 overlays a portion of sidewall 546. In one embodiment, top 547 and sidewall 546 of a respective resilient bump 54 and base 52 of spring pad 50 form a substantially S-shaped cross-section in the compressed state. As such, a maximum compression of resilient bump 54 is obtained.

Figure 7:
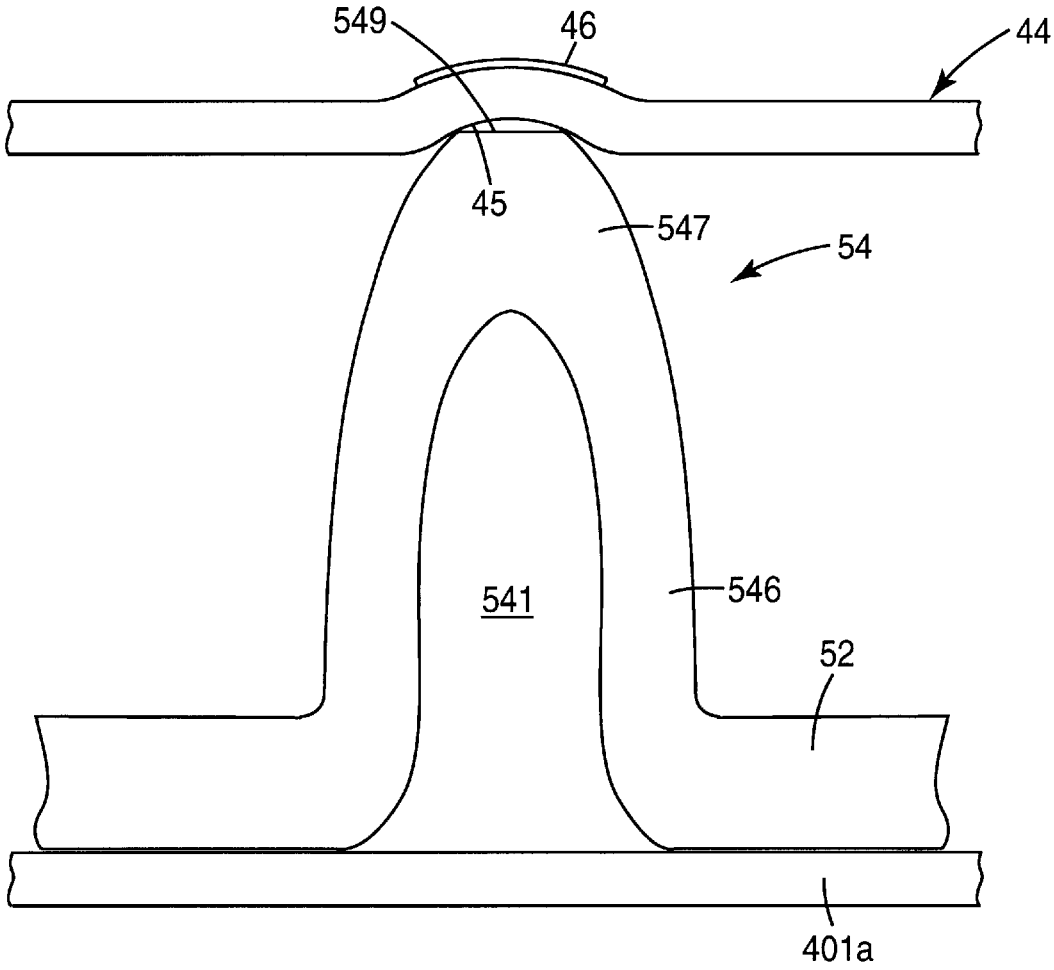
FIG. 7 is a schematic cross-sectional view similar to FIG. 6A illustrating another embodiment of a resilient bump according to the present invention.

In one embodiment, as illustrated in FIG. 6A, top 547 of each resilient bump 54 has a rounded tip 548 which fits into a recess or dimple 45 of electrical circuit 44. Dimple 45 is provided opposite of electrical contact 46. In another embodiment, as illustrated in FIG. 7, top 547 of each resilient bump 54 has a flattened tip 549. Flattened tip 549 improves a stability of resilient bump 54 as resilient bump 54 contacts electrical contact 46. Thus, top 547 with rounded tip 548 or flattened tip 549 contacts electrical circuit 44 in a region opposite of electrical contact 46. As such, resilient bump 54 biases electrical circuit 44 and, more specifically, electrical contact 46 away from sidewall 401*a* of printer carriage 40.

Figure 8:
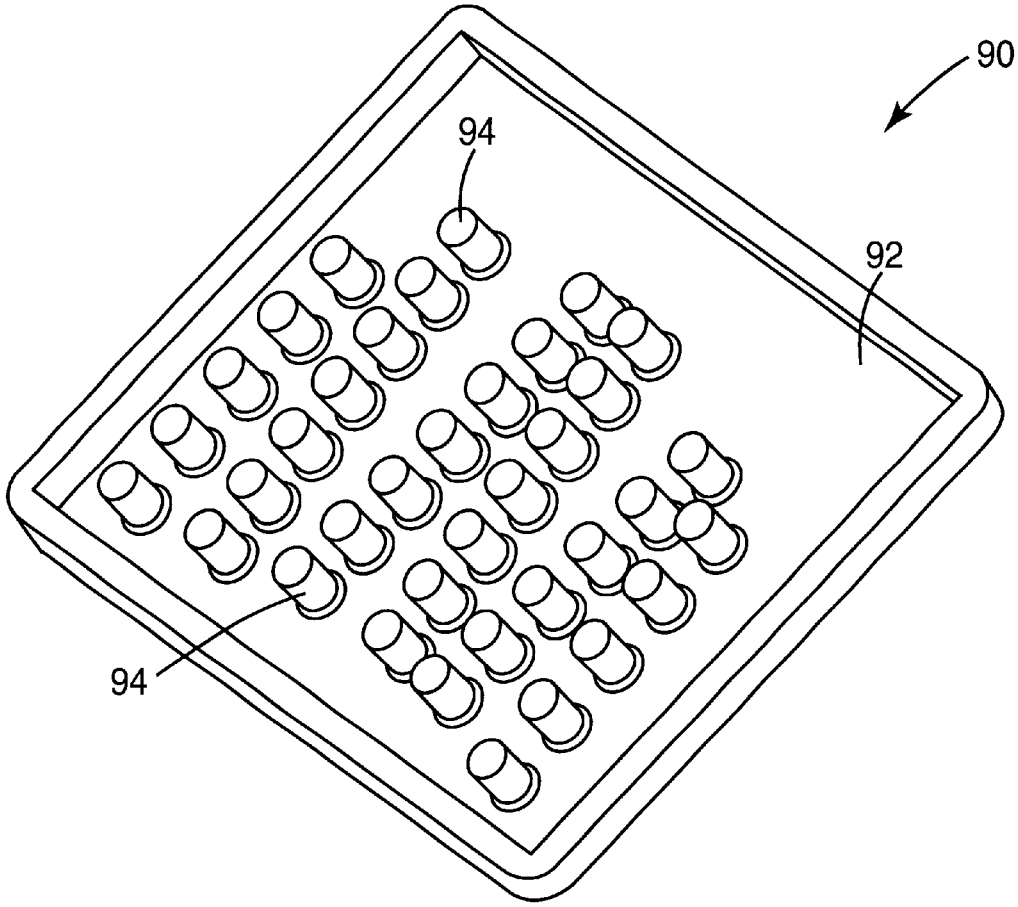
Fig. 8 PRIOR ART
FIG. 8 is a front perspective view of a prior art spring pad.

FIG. 8 illustrates one embodiment of a prior art spring pad 90. Spring pad 90 includes a base 92 and a plurality of resilient portions 94 protruding from base 92. Unlike resilient bumps 54 of spring pad 50, resilient portions 94 of prior art spring pad 90 each have a substantially cylindrical profile.

Figure 9:
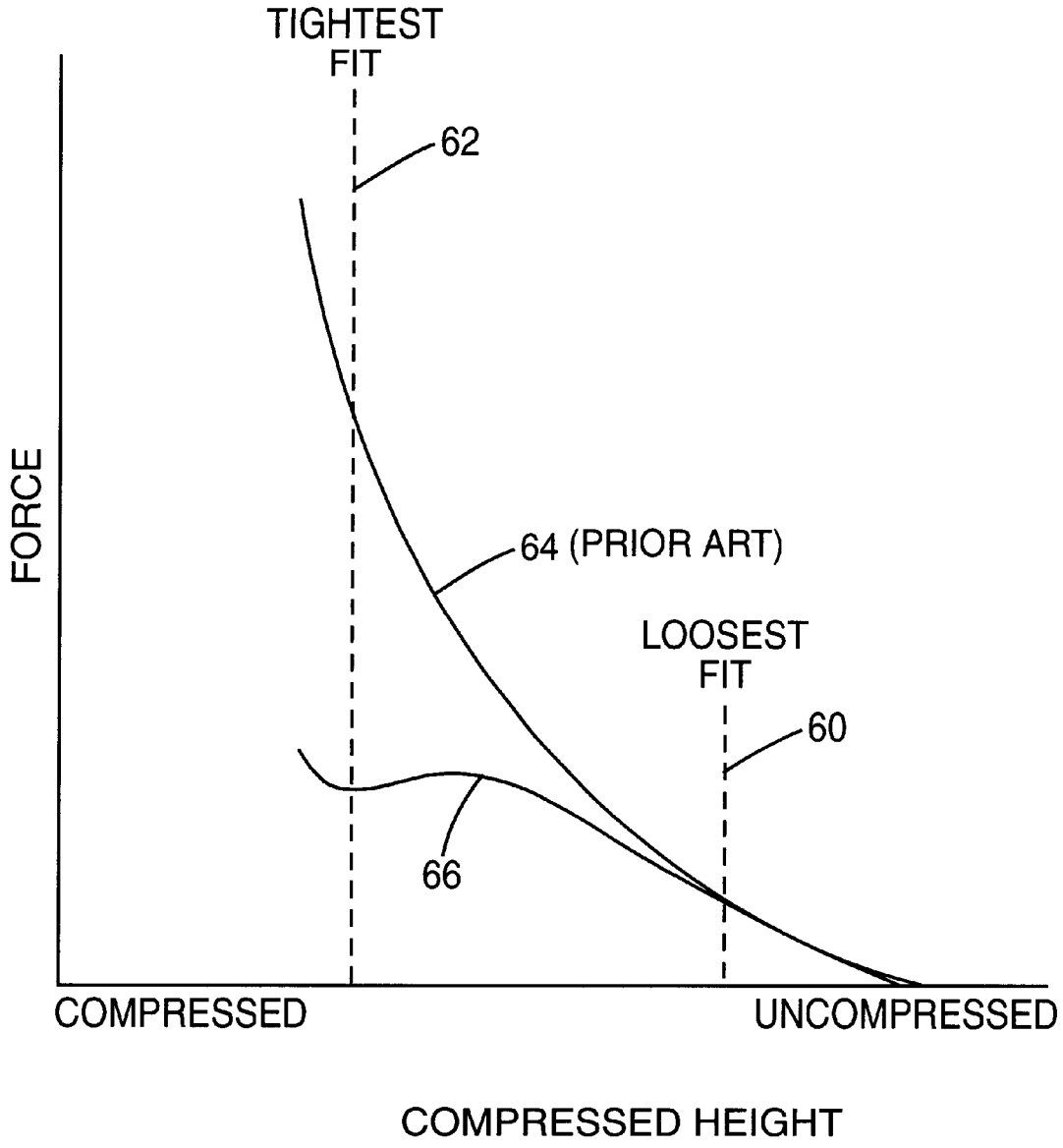
FIG. 9 is a graphical representation of force and compressed height of a resilient bump of the spring pad of FIG. 4 and a resilient portion of the prior art spring pad of FIG. 8.

FIG. 9 illustrates force and compressed height of resilient portions 94 of prior art spring pad 90 and resilient bumps 54 of spring pad 50. Dashed lines 60 and 62 illustrate an upper tolerance bound and a lower tolerance bound, respectively. The upper tolerance bound, as illustrated by line 60, represents a loosest fit of print cartridge 30 and printer carriage 40 and the lower tolerance bound, as illustrated by line 62, represents a tightest fit of print cartridge 30 and printer carriage 40. The upper tolerance bound, therefore, represents a minimum compression of resilient portions 94 of prior art spring pad 90 and resilient bumps 54 of spring pad 50 when print cartridge 30 is positioned in printer carriage 40. The lower tolerance bound represents a maximum compression of resilient portions 94 of prior art spring pad 90 and resilient bumps 54 of spring pad 54 when print cartridge 30 is positioned in printer carriage 40.

As illustrated by line 64, a force generated by resilient portion 94 of prior art spring pad 90 increases significantly as a compressed height of resilient portion 94 decreases. More specifically, as the compressed height of resilient portion 94 approaches the lower tolerance bound, the force generated by resilient portion 94 increases exponentially. Thus, a significant amount of force exists between electrical contacts 36 of print cartridge 30 and electrical contacts 46 of printer carriage 40 when print cartridge 30 is positioned in printer carriage 40 with prior art spring pad 90.

As illustrated by line 66, a force generated by resilient bump 54 of spring pad 50, however, is substantially constant during compression between the uncompressed state and the compressed state. Thus, as the compressed height of resilient bump 54 approaches the lower tolerance bound, the force generated by resilient bump 54 remains substantially constant. As such, a substantially constant force exists to ensure electrical interconnection between electrical contacts 36 of print cartridge 30 and electrical contacts 46 of printer carriage 40 when print cartridge 30 is positioned in printer carriage 40 with spring pad 50.

While, in one embodiment, forces generated by resilient portion 94 of prior art spring pad 90 and resilient bump 54 of spring pad 50 are generally equal at the upper tolerance bound, forces generated by resilient portion 94 of prior art spring pad 90 and resilient bump 54 of spring pad 50 very significantly at the lower tolerance bound. More specifically, at the lower tolerance bound, a force generated by resilient bumps 54 of spring pad 50 is significantly less than a force generated by resilient portions 94 of prior art spring pad 90. Thus, resilient bumps 54 of spring pad 50 maintain a minimum force during an operating range between the uncompressed state and the compressed state while minimizing a maximum force in the compressed state.

By buckling in a controlled manner between an uncompressed state and a compressed state, resilient bumps 54 of spring pad 50 provide a substantially constant force between electrical contacts 46 of printer carriage 40 and electrical contacts 36 of print cartridge 30. In addition, resilient bumps 54 minimize a maximum force developed between electrical contacts 36 and electrical contacts 46 when print cartridge 30 is installed in printer cartridge 40. By minimizing the maximum force developed between electrical contacts 36 and electrical contacts 46, materials for printer carriage 40 and or print cartridge 30 can be sized for lesser forces and need not be sized and/or selected for excessive forces. Furthermore, resilient bumps 54 maintain a minimum force to ensure good electrical contact or interconnection between electrical contacts 46 of printer carriage 40 and electrical contacts 36 of print cartridge 30.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A spring pad, comprising:

a base having a first side and a second side opposite the first side; and a plurality of resilient bumps protruding from the first side of the base, each of the resilient bumps having a substantially semi-ellipsoidal shape and including a hollow interior communicating with the second side of the base.

2. The spring pad of claim 1, wherein each of the resilient bumps are formed integrally with the base.

3. The spring pad of claim 1, wherein each of the resilient bumps includes a sidewall joined to the base and a top joined to the sidewall.

4. The spring pad of claim 3, wherein each of the resilient bumps are independently compressible between an uncompressed state and a compressed state, wherein the sidewall of a respective one of the resilient bumps is adapted to buckle in the compressed state.

5. The spring pad of claim 4, wherein the top and the sidewall of a respective one of the resilient bumps and the base of the spring pad form a substantially S-shaped cross-section in the compressed state of the respective one of the resilient bumps.

6. The spring pad of claim 3, wherein a thickness of the sidewall of a respective one of the resilient bumps is less than a thickness of the top of the respective one of the resilient bumps.

7. The spring pad of claim 3, wherein the top of each of the resilient bumps includes one of a rounded tip and a flattened tip.

8. The spring pad of claim 1, wherein each of the resilient bumps are configured to provide a substantially constant force when compressed.

9. The spring pad of claim 1, wherein the base includes a substantially planar portion, each of the resilient bumps protruding from the substantially planar portion of the base.

10. The spring pad of claim 9, wherein the substantially semi-ellipsoidal shape of each of the resilient bumps includes a major axis oriented substantially perpendicular to the substantially planar portion of the base and a minor axis oriented substantially perpendicular to the major axis.

11. The spring pad of claim 1, wherein the plurality of resilient bumps form an array of resilient bumps including at least one column of resilient bumps.

12. The spring pad of claim 1, wherein the base of the spring pad has at least one air vent opening extending therethrough, and further comprising:

a plurality of air vent channels formed in the second side of the base, at least one of the air vent channels communicating with the hollow interior of at least one of the resilient bumps and the at least one air vent opening.

13. The spring pad of claim 1, wherein the second side of the base is substantially planar.

14. A carriage assembly adapted to hold a printhead assembly of an inkjet printing system, the carriage assembly comprising:

a carriage adapted to support the printhead assembly;

a plurality of electrical contacts provided along a sidewall of the carriage; and a spring pad interposed between the sidewall of the carriage and the plurality of electrical contacts, wherein the spring pad includes a base and a plurality of resilient bumps each protruding from a first side of the base away from the sidewall of the carriage, each of the resilient bumps adapted to bias a respective one of the electrical contacts away from the sidewall of the carriage, wherein each of the resilient bumps have a substantially semi-elliptical cross-section and include a hollow interior communicating with a second side of the base opposite the first side thereof.

15. The carriage assembly of claim 14, wherein each of the resilient bumps are formed integrally with the base.

16. The carriage assembly of claim 14, wherein the second side of the base is substantially planar.

17. The carriage assembly of claim 13, wherein each of the resilient bumps includes a sidewall joined to the base and a top joined to the sidewall of a respective one of the resilient bumps.

18. The carriage assembly of claim 17, wherein each of the resilient bumps are independently compressible between an uncompressed state and a compressed state, wherein the sidewall of a respective one of the resilient bumps is adapted to buckle in the compressed state.

19. The carriage assembly of claim 18, wherein the top and the sidewall of a respective one of the resilient bumps and the base of the spring pad form a substantially S-shaped cross-section in the compressed state of the respective one of the resilient bumps.

20. The carriage assembly of claim 14, wherein each of the resilient bumps are configured to provide a substantially constant force when compressed.

21. The carriage assembly of claim 14, further comprising:

a flexible electrical circuit including the plurality of electrical contacts, wherein the flexible electrical circuit is positioned within the carriage and the spring pad is interposed between the sidewall of the carriage and the flexible electrical circuit.

22. The carriage assembly of claim 14, wherein the base of the spring pad is oriented substantially parallel to the sidewall of the carriage.

23. The carriage assembly of claim 22, wherein the second side of the base contacts the sidewall of the carriage.

24. An inkjet printing system, comprising:

a print cartridge including an inkjet printhead assembly and a first plurality of electrical contacts electrically coupled to the inkjet printhead assembly; and a printer carriage including a second plurality of electrical contacts, wherein the printer carriage is adapted to hold the print cartridge and the first plurality of electrical contacts are adapted to contact the second plurality of electrical contacts, wherein the printer carriage includes a spring pad having a base and a plurality of resilient bumps each protruding from a first side of the base toward and associated with one of the second plurality of electrical contacts, wherein each of the resilient bumps include a hollow interior communicating with a second side of the base opposite the first side thereof and are adapted to provide a substantially constant force between one of the first plurality of electrical contacts and one of the second plurality of electrical contacts when compressed.

25. The inkjet printing system of claim 24, wherein each of the resilient bumps have a substantially semi-ellipsoidal shape.

26. The inkjet printing system of claim 24, wherein the second side of the base is substantially planar.

27. The inkjet printing system of claim 24, wherein the second side of the base contacts the printer carriage.

28. The inkjet printing system of claim 24, wherein each of the resilient bumps includes a sidewall adapted to buckle when a respective one of the resilient bumps is compressed.

29. The inkjet printing system of claim 28, wherein each of the resilient bumps further includes a top joined to the sidewall, and wherein a portion of the top of a respective one of the resilient bumps overlays a portion of the sidewall of the respective one of the resilient bumps when the respective one of the resilient bumps is compressed.

30. A method of electrically connecting a print cartridge including an inkjet printhead assembly and a printer carriage adapted to support the print cartridge, the method comprising the steps of:

electrically contacting at least one electrical contact of the printer carriage with at least one electrical contact of the print cartridge; and biasing the at least one electrical contact of the printer carriage against the at least one electrical contact of the print cartridge with a resilient bump associated with the at least one electrical contact of the printer carriage, the resilient bump protruding from a first side of a base and having a hollow interior communicating with a second side of the base opposite the first side thereof, wherein biasing the at least one electrical contact of the printer carriage includes compressing the resilient bump and buckling a sidewall of the resilient bump.

31. The method of claim 30, wherein biasing the at least one electrical contact of the printer carriage includes biasing the at least one electrical contact of the printer carriage against the at least one electrical contact of the print cartridge with a substantially constant force.

32. The method of claim 30, further comprising the steps of:

positioning a flexible electrical circuit including the at least one electrical contact of the printer carriage in the printer carriage; and interposing a spring pad including the base and the resilient bump between a sidewall of the printer carriage and the flexible electrical circuit.

33. The method of claim 32, wherein buckling the sidewall of the resilient bump includes overlapping the base of the spring pad with the sidewall of the resilient bump and overlapping the sidewall of the resilient bump with a top of the resilient bump.

34. The method of claim 32, wherein interposing the spring pad between the sidewall of the printer carriage and the flexible electrical circuit includes contacting the sidewall of the printer carriage with the second side of the base.

* * * * *